US009374883B2

(12) United States Patent
Park et al.

(10) Patent No.: US 9,374,883 B2
(45) Date of Patent: Jun. 21, 2016

(54) PLASMA LIGHT SOURCE APPARATUS AND PLASMA LIGHT GENERATING METHOD

(71) Applicant: SAMSUNG ELECTRONICS CO., LTD., Suwon-si, Gyeonggi-do (KR)

(72) Inventors: Young-Kyu Park, Incheon (KR); Wook-Rae Kim, Suwon-si (KR); Byeong-Hwan Jeon, Yongin-si (KR); Hashimoto Kohei, Suwon-si (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 14/560,732

(22) Filed: Dec. 4, 2014

(65) Prior Publication Data

US 2015/0163893 A1 Jun. 11, 2015

(30) Foreign Application Priority Data

Dec. 5, 2013 (KR) ..... 10-2013-0150495

(51) Int. Cl.
*H05G 2/00* (2006.01)

(52) U.S. Cl.
CPC ..... *H05G 2/008* (2013.01); *H05G 2/003* (2013.01)

(58) Field of Classification Search
CPC ..... H05G 2/008; H05G 2/003; H05H 1/00; H01S 3/00
See application file for complete search history.

(56) References Cited

U.S. PATENT DOCUMENTS

| | | | | |
|---|---|---|---|---|
| 6,908,218 | B2 | 6/2005 | Sato et al. | |
| 7,435,982 | B2 | 10/2008 | Smith | |
| 8,198,613 | B2 | 6/2012 | Moriya et al. | |
| 8,242,695 | B2 | 8/2012 | Sumitomo et al. | |
| 8,309,943 | B2 | 11/2012 | Smith et al. | |
| 8,416,509 | B2 | 4/2013 | Yi et al. | |
| 2007/0228300 | A1 * | 10/2007 | Smith | B82Y 10/00 250/504 R |
| 2009/0040906 | A1 | 2/2009 | Hong et al. | |
| 2010/0164347 | A1 | 7/2010 | Yasuda et al. | |
| 2010/0259742 | A1 | 10/2010 | Singer | |
| 2011/0064112 | A1 | 3/2011 | Oumiskov et al. | |
| 2012/0085933 | A1 | 4/2012 | Doi et al. | |
| 2012/0091893 | A1 | 4/2012 | Yanagida et al. | |
| 2012/0241649 | A1 * | 9/2012 | Nishihara | H05G 2/008 250/504 R |
| 2012/0248342 | A1 | 10/2012 | Moriya et al. | |
| 2013/0003384 | A1 * | 1/2013 | Bezel | G02B 26/06 362/276 |
| 2013/0105712 | A1 * | 5/2013 | Yanagida | H05G 2/003 250/504 R |
| 2013/0153794 | A1 * | 6/2013 | Wakabayashi | H05G 2/008 250/504 R |

* cited by examiner

*Primary Examiner* — Jack Berman
*Assistant Examiner* — Eliza Osenbaugh-Stewar
(74) *Attorney, Agent, or Firm* — F. Chau & Associates, LLC

(57) ABSTRACT

A plasma light source apparatus is provided. The plasma light source apparatus includes a chamber, a laser generating part, and a curved mirror. The chamber includes a plasma source gas for generating laser induced plasma. The laser generating part is spaced apart from the chamber and generates a hollow laser beam. The curved mirror is disposed between the chamber and the laser generating part. The curved mirror is configured to reflect and to condense the generated hollow laser beam into the chamber to generate the laser induced plasma in the chamber, and to reflect light emitted from the generated laser induced plasma.

20 Claims, 7 Drawing Sheets

PLASMA LIGHT SOURCE APPARATUS AND PLASMA LIGHT GENERATING METHOD

CROSS-REFERENCE TO RELATED APPLICATION

This application claims priority under 35 U.S.C. §119 to Korean Patent Application No. 10-2013-0150495, filed on Dec. 5, 2013 in the Korean Intellectual Property Office (KIPO), the disclosure of which is incorporated by reference herein in its entirety.

TECHNICAL FIELD

The present inventive concept relates to a plasma light source, and, more particularly, to a plasma light source apparatus and a plasma light generating method.

DISCUSSION OF THE RELATED ART

Since a plasma light source may generate light of various wavelengths and employ an electrodeless lamp structure, light loss or scattered reflection through an electrode is prevented.

To generate the plasma light source, a laser beam having a circular shape may be incident on a curved mirror. In this case, the laser induced plasma might not have a circular shape, but may instead have a linear or an oval shape. In addition, the laser induced plasma might not be generated at the center of a chamber, but near a chamber wall, and thus, setting a focus of a condensing lens may be difficult. Accordingly, a condensing efficiency and an intensity of the plasma light may become low.

SUMMARY

According to an exemplary embodiment of the present inventive concept, a plasma light source apparatus is provided. The plasma light source apparatus includes a chamber, a laser generating part, and a curved mirror. The chamber includes a plasma source gas for generating laser induced plasma. The laser generating part is spaced apart from the chamber and configured to generate a hollow laser beam. The curved mirror is disposed between the chamber and the laser generating part. The curved mirror is configured to reflect and to condense the generated hollow laser beam to generate the laser induced plasma in the chamber, and to reflect light emitted from the generated laser induced plasma.

In an exemplary embodiment of the present inventive concept, the plasma light source apparatus may further include a first mirror and a condensing lens part. The first mirror may reflect the light reflected by the curved mirror. The condensing lens part may condense the light reflected by the first mirror.

In an exemplary embodiment of the present inventive concept, the plasma light source apparatus may further include a calibration part positioned on a path of the generated hollow laser beam. The calibration part may calibrate a distortion of the generated hollow laser beam.

In an exemplary embodiment of the present inventive concept, the condensing lens part may include a concave lens or a convex lens.

In an exemplary embodiment of the present inventive concept, the plasma light source apparatus may further include a second mirror positioned on a path of the hollow laser beam. The second mirror may be configured to reflect the hollow laser beam to the curved mirror.

In an exemplary embodiment of the present inventive concept, the laser generating part may include an axicon lens.

In an exemplary embodiment of the present inventive concept, the laser generating part may include a first laser source, a second laser source, and a first transformation part. The first laser source may generate a circular first laser beam having a pulse wave. The second laser source for generating a circular second laser beam having a continuous wave. The first transformation part may be positioned on paths of the first and second laser beams. The first transformation part may be configured to transform the first and second laser beams into the hollow laser beam.

In an exemplary embodiment of the present inventive concept, the laser generating part may include a first laser source, a third laser source, a first transformation part, and a second transformation part. The first laser source may generate a first laser beam having a pulse wave and a first wavelength. The third laser source may generate a third laser beam having a continuous wave and a second wavelength different from the first wavelength. The first transformation part may be positioned on a path of the first laser beam. The first transformation part may be configured to transform the first laser beam into the hollow laser beam. The second transformation part may be positioned on a path of the third laser beam. The second transformation part may be configured to transform the third laser beam into the hollow laser beam.

In an exemplary embodiment of the present inventive concept, the chamber may have a spherical shape and include fused silica or quartz glass.

According to an exemplary embodiment of the present inventive concept, a method for generating plasma light. The method includes generating a hollow laser beam, reflecting and condensing the generated hollow laser beam into a chamber including a plasma source gas using a curved mirror, and generating laser induced plasma in the chamber. The method may further include reflecting a first light emitted from the generated laser induced plasma using the curved mirror.

In an exemplary embodiment of the present inventive concept, the method may further include reflecting the first light reflected by the curved mirror to a condensing lens part using a first mirror. The first mirror may be disposed on a path of the first light reflected by the curved mirror.

In an exemplary embodiment of the present inventive concept, the method may further include calibrating a distortion of the hollow laser beam using a calibration part. The calibration part may be disposed on a path of the hollow laser beam In an exemplary embodiment of the present inventive concept, the method may further include reflecting the hollow laser beam to the curved mirror using a second mirror. The second mirror may be disposed on a path of the hollow laser beam.

In an exemplary embodiment of the present inventive concept, the generating of the hollow laser beam may include generating a circular first laser beam having a pulse wave using a first laser source, generating a circular second laser beam having a continuous wave using a second laser source, and transforming the first and second laser beams into the hollow laser beam using a first transformation part. The first transformation part may be disposed on paths of the first and second laser beams.

In an exemplary embodiment of the present inventive concept, the generating of the hollow laser beam may include generating a circular first laser beam having a pulse wave and a first wavelength using a first laser source, generating a circular third laser beam having a continuous wave and a second wavelength using a third laser source, and transforming the first and third laser beams into the hollow laser beam.

According to an embodiment of the present inventive concept, a method for generating light is provided. The method includes generating first and second laser beams, transforming the first and second laser beams into a hollow laser beam, reflecting and condensing the hollow laser beam using a curved mirror to generate laser induced plasma in a chamber, reflecting light emitted from the generated laser induced plasma using the curved mirror, and condensing the light reflected using the curved mirror.

In an exemplary embodiment of the present inventive concept, the first laser beam may have a pulse wave and the second laser beam may have a continuous wave.

In an exemplary embodiment of the present inventive concept, the first laser beam may have a pulse wave and a first wavelength, and the second laser beam may have a continuous wave and a second wavelength different from the first wavelength.

In an exemplary embodiment of the present inventive concept, the method may further include calibrating a distortion of the hollow laser beam.

In an exemplary embodiment of the present inventive concept, the method may further include reflecting the hollow laser beam to the curved mirror using a first mirror. The first mirror may be disposed on a path of the generated hollow laser beam.

BRIEF DESCRIPTION OF THE DRAWINGS

Exemplary embodiments of the present inventive concept will be more clearly understood from the following detailed description taken in conjunction with the accompanying drawings, wherein.

DESCRIPTION OF EMBODIMENTS

Figure 1:
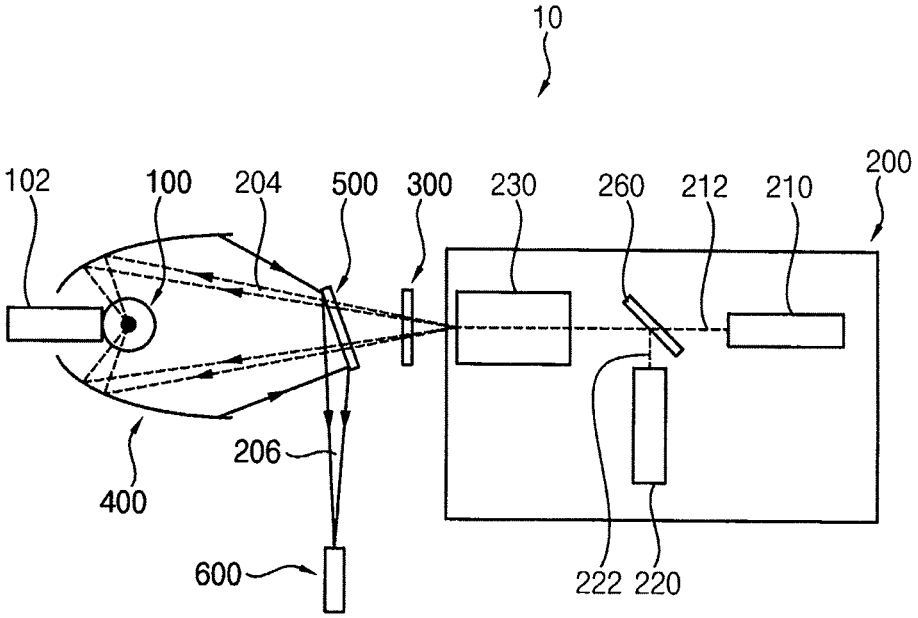
FIG. 1 is a cross-sectional view illustrating a plasma light source apparatus in accordance with an exemplary embodiment of the present inventive concept.

Various exemplary embodiments of the present inventive concept will be described more fully hereinafter with reference to the accompanying drawings, in which some exemplary embodiments are shown. The present inventive concept may, however, be embodied in various different forms and should not be construed as limited to the exemplary embodiments set forth herein. Rather, these exemplary embodiments are provided so that this description will be thorough and complete, and will fully convey the scope of the present inventive concept to those skilled in the art. In the drawings, the sizes and relative sizes of layers and regions may be exaggerated for clarity.

Like numerals may refer to like elements throughout the specification and figures.

It will be understood that, although the terms first, second, third, fourth etc. may be used herein to describe various elements, components, regions, layers and/or sections, these elements, components, regions, layers and/or sections should not be limited by these terms.

As used herein, the singular forms "a," "an" and "the" are intended to include the plural forms as well, unless the context clearly indicates otherwise.

Exemplary embodiments are described herein with reference to cross-sectional illustrations that are idealized schematic illustrations and intermediate structures.

Figure 2:
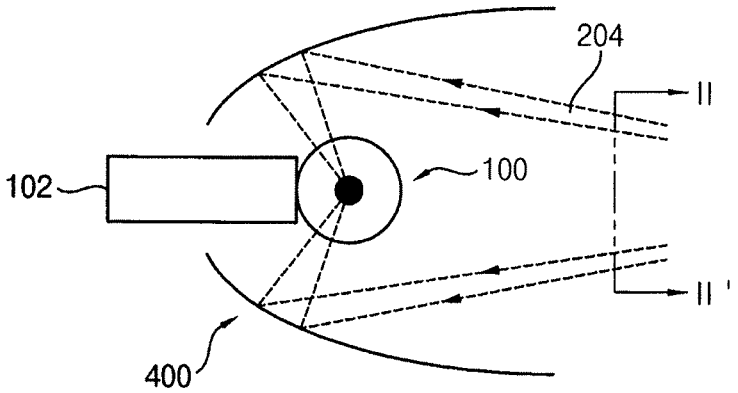
FIG. 2 is a cross-sectional view illustrating a shape and a position of plasma light generated by the plasma light source in FIG. 1.
Figure 3:
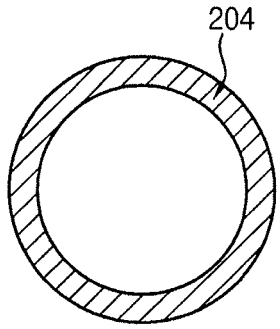
FIG. 3 is a cross-sectional view cut along the line II-II' of FIG. 2.

FIG. 1 is a cross-sectional view illustrating a plasma light source apparatus in accordance with an exemplary embodiment of the present inventive concept. FIG. 2 is a cross-sectional view illustrating a shape and a position of plasma light generated by the plasma light source in FIG. 1. FIG. 3 is a cross-sectional view taken along the line II-II' in FIG. 2.

Referring to FIGS. 1 to 3, a plasma light source apparatus 10 may include a chamber 100 filled with a plasma source gas, a laser generating part 200 for generating a hollow laser beam 204, a curved mirror 400 for reflecting and condensing the hollow laser beam 204, a first mirror 500, and a condensing lens part 600.

In an exemplary embodiment of the present inventive concept, the chamber 100 may provide a space in which plasma is generated and may have a shape and a structure which may withstand a given pressure. The chamber 100 may include a transparent and structurally stable material for allowing the laser beam to pass through the chamber 100. For example, the chamber 100 may have a spherical shape and may include fused silica or quartz glass. A chamber support 102 may support the chamber 100 such that the chamber 100 may be spaced apart from the curved mirror 400 by a predetermined distance.

The plasma source gas may include an inert gas. For example, the plasma source gas may include Ar, Xe, etc. The plasma source gas may include various gases in accordance with a kind of a desired light. When chemical composition of the plasma source gas is changed, a lifetime of the plasma light source may be changed. Accordingly, the plasma source gas may include the inert gas which is chemically stable. Based on a desired intensity of the light, a pressure of the plasma source gas in the chamber 100 may be controlled. The plasma source gas may include metal to control a spectral brightness (e.g., a brightness according to a wavelength). For example, the plasma source gas may include Hg, Se, I, TeI, Cd, etc.

In an exemplary embodiment of the present inventive concept, the laser generating part 200 may be spaced apart from the chamber 100 and may generate the hollow laser beam 204 for generating laser induced plasma from the plasma source gas. The laser generating part 200 may include a first laser source 210, a second laser source 220, and a first transformation part 230.

The first laser source 210 may generate a first laser beam 212 which has a circular pulse wave. The first laser beam 212 generated by the first laser source 210 may have a high-powered pulse wave for an initial ignition of the laser induced plasma. The generated first laser beam 212 may be incident on the first transformation part 230.

The second laser source 220 may generate a second laser beam 222 which has a circular continuous wave. The second laser beam 222 generated by the second laser source 210 may have a continuous wave for maintenance of the laser induced plasma generated by the first laser beam 212 of the first laser source 210. The generated second laser beam 222 may be reflected by a mirror 260 to be incident on the first transformation part 230.

The mirror 260 may be positioned on the path of the second laser beam 222 to reflect the second laser beam 222 and to match the path of the first laser beam 212 and the path of the second laser beam 222, and thus, the second laser beam 222 may be incident on the first transformation part 230.

The first transformation part 230 may be positioned on the path of the first laser beam 212 and the second laser beam 222 reflected by the mirror 260 and thus, the incident circular first laser beam 212 and the incident circular second laser beam 222 may be transformed into the hollow laser beam 204, and as illustrated in FIGS. 2 and 3, the transformed hollow laser beam 204 may be incident on the curved mirror 400.

For example, the first transformation part 230 may include an axicon lens. The first transformation part 230 may further include a concave lens or a convex lens.

In an exemplary embodiment of the present inventive concept, the curved mirror 400 may be arranged between the chamber 100 and the laser generating part 200, and the curved mirror 400 may surround the chamber 100. The curved mirror 400 may reflect and condense the hollow laser beam 204 generated by the laser generating part 200 into the chamber 100 to generate the laser induced plasma from the plasma source gas. In addition, the curved mirror 400 may reflect light 206 emitted from the laser induced plasma to be incident on a first mirror 500.

The first mirror 500 may be positioned on the path of the light 206 reflected by the curved mirror 400 and thus, the light 206 may be incident on the condensing lens part 600. For example, the first mirror 500 may be a dichroic mirror which selectively reflects ultraviolet rays.

The condensing lens part 600 may be positioned on the path of the light 206 reflected by the first mirror 500 and may condense the light 206, and thus, the light 206 may be incident on a desired region. The condensing lens part 600 may further include a concave lens or a convex lens.

In an exemplary embodiment of the present inventive concept, the plasma light source apparatus 10 may further include a calibration part 300 which calibrates a distortion of the hollow laser beam 204. The calibration part 300 may be arranged between the laser generating part 200 and the first mirror 500. For example, the calibration part 300 may calibrate the distortion of the hollow laser beam 204 caused by existence of the first mirror 500 between the laser generating part 200 and the curved mirror 400.

Referring again to FIG. 2, when the hollow laser beam 204 is incident on the curved mirror 400 to be reflected and be condensed, the laser induced plasma may be generated at the center region of the chamber 100. In addition, the generated laser induced plasma has a circular shape.

Hereinafter, a shape and a position of plasma generated by a plasma light source will be described with reference to FIGS. 4 and 5.

Figure 4:
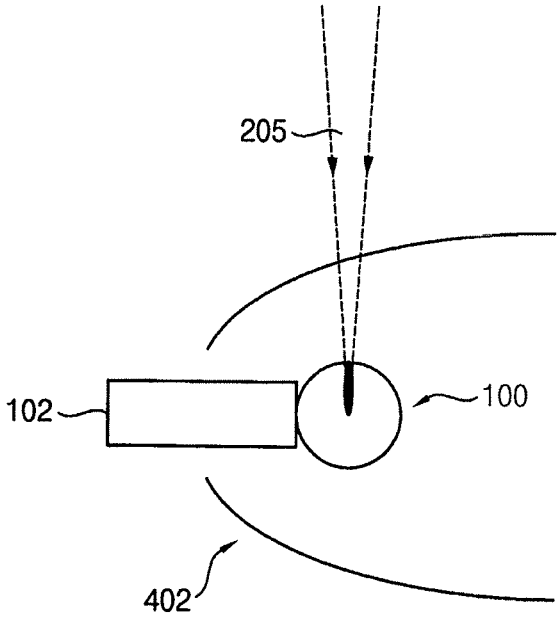
FIGS. 4 and 5 are cross-sectional views illustrating a shape and a position of plasma generated by a plasma light source.
Figure 5:
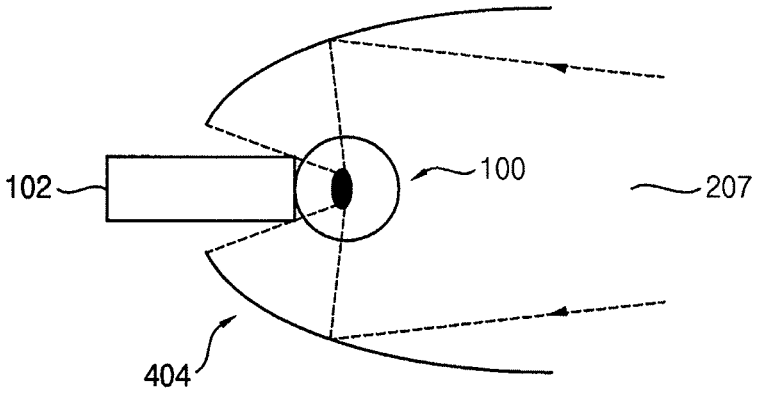

FIGS. 4 and 5 are cross-sectional views illustrating a shape and a position of plasma generated by a plasma light source.

In a plasma light source illustrated in FIG. 4, a condensed laser beam 205 may be incident through an opening formed at a sidewall of a curved mirror 402. The incident laser beam 205 may generate laser induced plasma from the plasma source gas injected in the chamber 100.

The laser induced plasma may be generated at a region other than the center region of the chamber 100. For example, the laser induced plasma might not have a circular shape in a cross-section. When a shape of the generated laser induced plasma is not circular, a condensing efficiency of light from the generated laser induced plasma may be low.

In a plasma light source illustrated in FIG. 5, a circular laser beam 207 may be reflected and condensed by a curved mirror 404. The reflected, condensed, and circular laser beam 207 may generate the laser induced plasma from the plasma source gas injected in the chamber 100.

The laser induced plasma may be generated at a region other than the center region of the chamber 100. The generated laser induced plasma might not have a circular shape but may instead have an oval shape. A condensing efficiency of light form the generated laser induced plasma may be low.

According to a plasma light source in accordance with an exemplary embodiment of the present inventive concept, the hollow laser beam 204 may be reflected and condensed to generate the laser induced plasma and thus, the generated laser induced plasma may have a circular shape. The laser induced plasma may be generated at the center region of the chamber 100. When the plasma light 206 emitted from the generated laser induced plasma is condensed, the condensing efficiency of the light 206 may be high. The hollow laser beam 204 may be reflected, condensed, and incident on a smaller region than that of the circular laser beam generated in the plasma light sources of FIGS. 4 and 5, and thus, the plasma light source in accordance with an exemplary embodiment of the present inventive concept may generate high density plasma. The intensity of the light 206 emitted from the high density plasma may be great.

Figure 6:
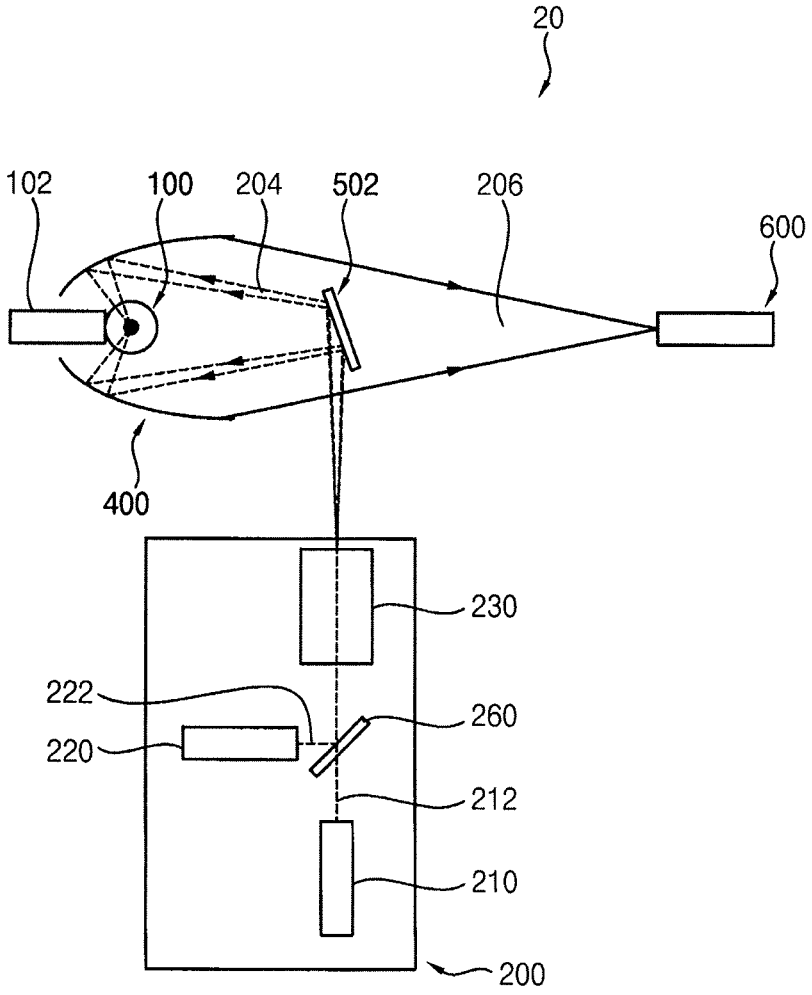
FIG. 6 is a cross-sectional view illustrating a plasma light source apparatus in accordance with an exemplary embodiment of the present inventive concept.

FIG. 6 is a cross-sectional view illustrating a plasma light source apparatus in accordance with an exemplary embodiment of the present inventive concept. The plasma light source apparatus may be substantially the same as or similar to that of FIG. 1, except for a second mirror, an absence of a calibration part, and positions of a laser generating part and a condensing lens part. Thus, like reference numerals may refer to like elements, and detailed descriptions thereon are omitted herein.

Referring to FIG. 6, a plasma light source apparatus 20 may include a chamber 100 filled with a plasma source gas, a laser generating part 200 for generating a hollow laser beam 204, a curved mirror 400 for reflecting and condensing the generated hollow laser beam 204, a second mirror 502, and a condensing lens part 600.

In an exemplary embodiment of the present inventive concept, the chamber 100 may provide a space in which plasma is generated and may have a shape and a structure which may withstand a given pressure. For example, the chamber 100 may have a spherical shape and may include fused silica or quartz glass. A chamber support 102 may support the chamber 100 and may space the chamber 100 apart from the curved mirror 400 at a predetermined distance.

The plasma source gas may include an inert gas. For example, the plasma source gas may include Ar, Xe, etc. The plasma source gas may include the inert gas which is chemically stable. The plasma source gas may include metal to control a spectral brightness. For example, the plasma source gas may include Hg, Se, I, TeI, Cd, etc.

The laser generating part 200 may be spaced apart from the chamber 100 and may generate the hollow laser beam 204 to generate laser induced plasma from the plasma source gas. The laser generating part 200 may include a first laser source 210, a second laser source 220, and a first transformation part 230.

For example, the first transformation part 230 may include an axicon lens. The first transformation part 230 may further include a concave lens or a convex lens.

The second mirror 502 may be positioned on the path of the hollow laser beam 204 generated by the laser generating part 200 to reflect the generated hollow laser beam 204 to be incident on the curved mirror 400. For example, the second mirror 502 may be arranged between the laser generating part 200 and the curved mirror 400.

The curved mirror 400 may be arranged between the chamber 100 and the laser generating part 200, and the curved mirror 400 may surround the chamber 100. The curved mirror 400 may reflect and condense the hollow laser beam 204 generated by the laser generating part 200 to generate the laser induced plasma from the plasma source gas. The curved mirror 400 may reflect light 206 emitted from the laser induced plasma to be incident on the condensing lens part 600.

The condensing lens part 600 may be positioned on the path of the emitted light 206 and may condense the light 206, and thus, the light 206 may be incident on a desired region.

As illustrated above, the hollow laser beam 204 may be reflected and condensed to the generated laser induced plasma and thus, the laser induced plasma has a circular shape and the laser induced plasma is generated at the center region of the chamber 100. For example, since the first mirror 500 does not exist in FIG. 6, the hollow laser beam 204 might not have distortion. Thus, a calibration for the distortion of the hollow laser beam 204 might not be needed, and thus a structure of the plasma light source apparatus 20 may be relatively simple.

Figure 7:
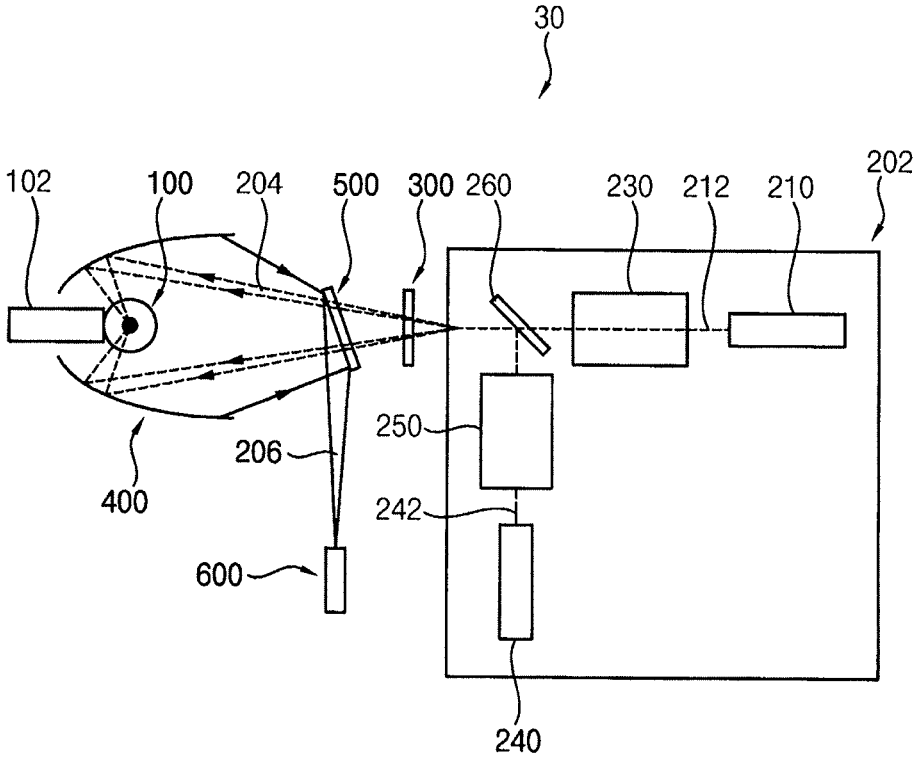
FIG. 7 is a cross-sectional view illustrating a plasma light source apparatus in accordance with an exemplary embodiment of the present inventive concept.

FIG. 7 is a cross-sectional view illustrating a plasma light source apparatus in accordance with an exemplary embodiment of the present inventive concept. The plasma light source apparatus may be substantially the same as or similar to that of FIG. 1, except for a laser generating part. Thus, like reference numerals may refer to like elements, and detailed descriptions thereon are omitted herein.

Referring to FIG. 7, a plasma light source apparatus 30 may include a chamber 100 filled with a plasma source gas, a laser generating part 202 for generating a hollow laser beam 204, a curved mirror 400 for reflecting and condensing the generated hollow laser beam 204, a first mirror 500, and a condensing lens part 600.

The chamber 100 may provide a space in which plasma is generated and may have a shape and a structure which may withstand a given pressure.

The plasma source gas may include an inert gas. For example, the plasma source gas may include Ar, Xe, etc. The plasma source gas may include various gases in accordance with a kind of a desired light. The plasma source gas may include metal to control a spectral brightness. For example, the plasma source gas may include Hg, Se, I, TeI, Cd, etc.

The laser generating part 202 may be spaced apart from the chamber 100 and may generate the hollow laser beam 204 to generate laser induced plasma from the plasma source gas. The laser generating part 202 may include a first laser source 210, a third laser source 240, a first transformation part 230, and a second transformation part 250.

The first laser source 210 may generate a first laser beam 212 which has a circular pulse wave. The first laser source 210 may generate the first laser beam 212 having a high-powered pulse wave. The first laser beam 212 is used for an initial ignition of the laser induced plasma. The generated first laser beam 212 may be incident on the first transformation part 230.

The first transformation part 230 may be positioned on the path of the first laser beam 212 and thus, the incident circular first laser beam 212 may be transformed into a hollow laser beam 204. Thus, the hollow laser beam 204 is incident on the curved mirror 400. The first transformation part 230 may include an axicon lens to transform the circular first laser beam 212 which has a first wavelength into the hollow laser beam 204.

The third laser source 240 may generate a third laser beam 242 which has a circular continuous wave. The third laser source 240 may generate the third laser beam 242 having a continuous wave. The third laser beam 242 is used for a maintenance of the laser induced plasma generated by the first laser beam 212 of the first laser source 210.

The second transformation part 250 may be positioned on the path of the third laser beam 242 and thus, the incident circular third laser beam 242 may be transformed into the hollow laser beam 204 which is incident on a mirror 260. The second transformation part 250 may include an axicon lens to transform the circular third laser beam 242 which has a second wavelength into the hollow laser beam 204.

The mirror 260 may be positioned on the path of the third laser beam 242 to reflect the third laser beam 242 and to match the path of the first laser beam 212 and the path of the third laser beam 242, and thus, the third laser beam 242 may be incident on the curved mirror 400.

The curved mirror 400 may be arranged between the chamber 100 and the laser generating part 202, and the curved mirror 400 may surround the chamber 100. The curved mirror 400 may reflect and condense the hollow laser beam 204 generated by the laser generating part 202 to generate the laser induced plasma from the plasma source gas. The curved mirror 400 may reflect light 206 emitted from the laser induced plasma to be incident on a first mirror 500.

The first mirror 500 may be positioned on the path of the light 206 reflected by the curved mirror 400 and thus, the light 206 may be incident on the condensing lens part 600. For example, the first mirror 500 may be a dichroic mirror which selectively reflects ultraviolet rays.

The condensing lens part 600 may be positioned on the path of the light 206 reflected by the first mirror 500 and may condense the light 206 and thus, the light 206 may be incident on a desired region. The condensing lens part 600 may further include a concave lens or a convex lens.

In an exemplary embodiment of the present inventive concept, the plasma light source apparatus 10 may further include a calibration part 300 which calibrate a distortion of the hollow laser beam 204. The calibration part 300 may be arranged between the laser generating part 202 and the first mirror 500.

As illustrated above, the laser induced plasma generated by the plasma light source apparatus in accordance with an exemplary embodiment of the present inventive concept may have a circular shape. The generated laser induced plasma may be generated at the center region of the chamber 100, and thus, the light 206 may easily be condensed. By using different laser beams which have different wavelengths, the laser induced plasma may emit light which has a desired intensity.

Figure 8:
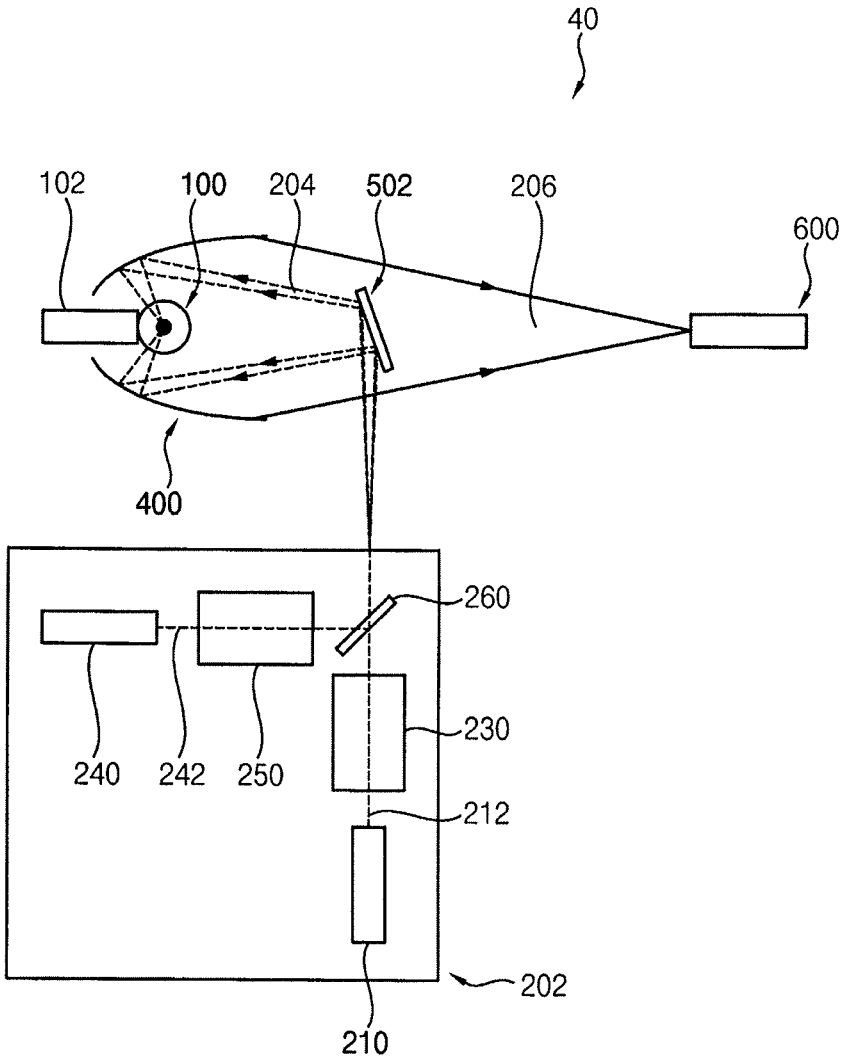
FIG. 8 is a cross-sectional view illustrating a plasma light source apparatus in accordance with an exemplary embodiment of the present inventive concept.

FIG. 8 is a cross-sectional view illustrating a plasma light source apparatus in accordance with an exemplary embodiment of the present inventive concept. The plasma light source apparatus may be substantially the same as or similar to that of FIG. 6, except for a laser generating part. Thus, like reference numerals may refer to like elements, and detailed descriptions thereon are omitted herein.

Referring to FIG. 8, a plasma light source apparatus 40 may include a chamber 100 filled with a plasma source gas, a laser generating part 202 for generating a hollow laser beam 204, a curved mirror 400 for reflecting and condensing the generated hollow laser beam 204, a second mirror 502, and a condensing lens part 600.

The chamber 100 may provide a space in which plasma is generated and may have a shape and a structure which may withstand a given pressure.

The laser generating part 202 may be spaced apart from the chamber 100 and may generate the hollow laser beam 204 to generate laser induced plasma from the plasma source gas. The laser generating part 202 may include a first laser source 210, a third laser source 240, a first transformation part 230, and a second transformation part 250.

The first laser source 210 may generate a first laser beam 212 which has a circular pulse wave. The first laser source 210 may generate the first laser beam 212 having a high-powered pulse wave. The first laser beam 212 is used for an initial ignition of the laser induced plasma. The generated first laser beam 212 may be incident on the first transformation part 230.

The first transformation part 230 may be positioned on the path of the first laser beam 212 and thus, the incident circular first laser beam 212 may be transformed into a hollow laser beam 204. Thus, the hollow laser beam 204 is incident on the second mirror 502. The first transformation part 230 may include an axicon lens to transform the circular first laser beam 212 which has a first wavelength into the hollow laser beam 204.

The third laser source 240 may generate a third laser beam 242 which has a circular continuous wave. The third laser source 240 may generate the third laser beam 242 having a continuous wave. The third laser beam 242 is used for a maintenance of the laser induced plasma generated by the first laser beam 212 of the first laser source 210.

The second transformation part 250 may be positioned on the path of the third laser beam 242 and thus, the incident circular third laser beam 242 may be transformed into the hollow laser beam 204 which is incident on a mirror 260. The second transformation part 250 may include an axicon lens to transform the circular third laser beam 242 which has a second wavelength into the hollow laser beam 204.

The mirror 260 may be positioned on the path of the third laser beam 242 to reflect the third laser beam 242 and to match the path of the first laser beam 212 and the path of the third laser beam 242, and thus, the third laser beam 242 may be incident on the second mirror 502.

The second mirror 502 may be positioned on the path of the hollow laser beam 204 generated by the laser generating part 202 to reflect the generated hollow laser beam 204 to be incident on the curved mirror 400. For example, the second mirror 502 may be arranged between the laser generating part 202 and the curved mirror 400.

The curved mirror 400 may be arranged between the chamber 100 and the laser generating part 202, and the curved mirror 400 may surround the chamber 100. The curved mirror 400 may reflect and condense the hollow laser beam 204 generated by the laser generating part 202 to generate the laser induced plasma from the plasma source gas. The curved mirror 400 may reflect light 206 emitted from the laser induced plasma to be incident on the condensing lens part 600.

The condensing lens part 600 may be positioned on the path of the emitted light 206 and may condense the light 206, and thus the light 206 may be incident on a desired region.

As illustrated above, the hollow laser beam 204 may be reflected and condensed to the generated laser induced plasma and thus, the laser induced plasma has a circular shape and the laser induced plasma is generated at the center region of the chamber 100. For example, since the first mirror 500 does not exist in FIG. 8, the hollow laser beam 204 might not have distortion. Thus, a calibration for the distortion of the hollow laser beam 204 might not be needed. By using different laser beams which have different wavelengths, the laser induced plasma may emit the light which has a desired intensity.

Hereinafter, a method for generating plasma light in accordance with an exemplary embodiment of the present inventive concept will be explained.

Figure 9:
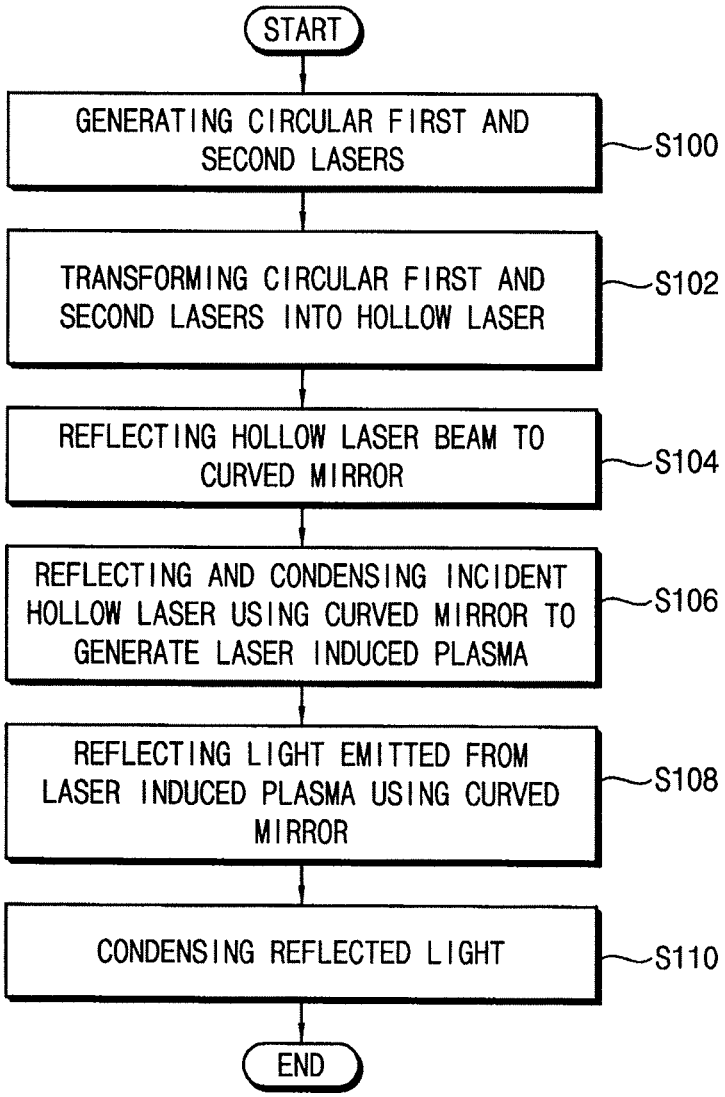
FIG. 9 is a flowchart illustrating a plasma light generating method in accordance with an exemplary embodiment of the present inventive concept.

FIG. 9 is a flowchart illustrating a method for generating plasma light in accordance with an exemplary embodiment of the present inventive concept.

Referring to FIG. 9, circular first and second laser beams may be generated (S100). For example, the first laser beam which has a pulse wave may be generated for initial ignition of laser induced plasma. The second laser beam which has a continuous wave may be generated for maintenance of the ignited laser induced plasma.

In an exemplary embodiment of the present inventive concept, the first laser beam which has a first wavelength and the second laser beam which has a second wavelength may be generated.

The generated first and second laser beams may be transformed into a hollow laser beam 204 (S102). For example, by using an axicon lens, the first and second laser beams may be transformed into the hollow laser beam 204.

In an exemplary embodiment of the present inventive concept, an axicon lens pertaining to the first wavelength may be provided to transform the circular first laser beam which has the first wavelength, and an axicon lens pertaining to the second wavelength may be provided to transform the circular second laser beam which has the second wavelength.

By using a first mirror, the generated hollow laser beam may be reflected and may be incident on a curved mirror (S104). In an embodiment of the present inventive concept, by using a second mirror, the generated hollow laser beam may be reflected and may be incident on a curved mirror (S104)

By using the curved mirror, the hollow laser beam may be reflected and condensed on a plasma source gas in a chamber to generate laser induced plasma (S106).

Light 206 emitted from the generated laser induced plasma may be reflected by the curved mirror 400 (S108). In an embodiment of the present inventive concept, the light reflected by the curved mirror may be reflected again by the first mirror to be incident on a condensing lens part, and a distortion of the hollow laser beam generated in S102 may be calibrated through a calibration part. In an embodiment of the present inventive concept, the light reflected by the curved mirror might not be reflected by the first mirror and incident on the condensing lens part.

The light emitted from the generated laser induced plasma may be condensed on a desired region using a condensing lens part (S110).

According to the method for generating the plasma light in accordance with an exemplary embodiment of the present inventive concept, the hollow laser beam may be reflected and condensed to generate the laser induced plasma, and thus, the generated laser induced plasma may have a circular shape. When the light emitted from the laser induced plasma is condensed, the condensing efficiency and the intensity of the light emitted from the laser induced plasma may be great.

The foregoing is illustrative of exemplary embodiments of the present inventive concept and the present inventive concept should not to be construed as being limited by the embodiments described herein. Although multiple exemplary embodiments have been described, it will be understood that various modifications in form and detail may be possible without departing from the spirit and scope of the present inventive concept.

What is claimed is:

1. A plasma light source apparatus, comprising: a chamber including a plasma source gas for generating laser induced plasma; a laser generating part spaced apart from the chamber, the laser generating part being configured to generate a hollow laser beam; and a curved mirror disposed between the chamber and the laser generating part, the curved mirror being configured to reflect and to condense the generated hollow laser beam to generate the laser induced plasma in the chamber, and to reflect a light emitted from the generated laser induced plasma, wherein the laser generating part includes a first laser source generating a first laser beam, a second laser source generating a second laser beam, and a transformation part, and wherein the transformation part transforms both of the first and second laser beams into the hollow laser beam.

2. The plasma light source apparatus of claim 1, further comprising:

a first mirror for reflecting the light reflected by the curved mirror; and a condensing lens part for condensing the light reflected by the first mirror.

3. The plasma light source apparatus of claim 2, further comprising a calibration part positioned on a path of the generated hollow laser beam, wherein the calibration part calibrates a distortion of the generated hollow laser beam.

4. The plasma light source apparatus of claim 2, wherein the condensing lens part comprises a concave lens or a convex lens.

5. The plasma light source apparatus of claim 1, further comprising a second mirror positioned on a path of the hollow laser beam, the second mirror being configured to reflect the hollow laser beam to the curved mirror.

6. The plasma light source apparatus of claim 1, wherein the laser generating part comprises an axicon lens.

7. The plasma light source apparatus of claim 1, wherein:

the first laser beam is a circular laser beam having a pulse wave, wherein the second laser beam is a circular laser beam having a continuous wave, and wherein the transformation part is positioned on paths of the first and second laser beams.

8. The plasma light source apparatus of claim 1, wherein the first laser beam has a pulse wave and a first wavelength, wherein the second laser beam has a continuous wave and a second wavelength different from the first wavelength, wherein the transformation part includes a first transformation part and a second transformation part, wherein the first transformation part is positioned on a path of the first laser beam, the first transformation part transforming the first laser beam into the hollow laser beam, and wherein the second transformation part is positioned on a path of the second laser beam, the second transformation part transforming the second laser beam into the hollow laser beam.

9. The plasma light source apparatus of claim 1, wherein the chamber has a spherical shape, and the chamber comprises fused silica or quartz glass.

10. A method for generating plasma light, the method comprising:

generating a hollow laser beam;

reflecting and condensing the generated hollow laser beam into a chamber including a plasma source gas using a curved mirror, and generating laser induced plasma in the chamber; and reflecting a first light emitted from the generated laser induced plasma using the curved mirror, wherein the generating a hollow laser beam includes generating a first laser beam using a first laser source and a second laser beam using a second laser source, and transforming the first and second laser beams into the hollow laser beam.

11. The method of claim 10, further comprising reflecting the first light reflected by the curved mirror to a condensing lens part using a first mirror, wherein the first mirror is disposed on a path of the first light reflected by the curved mirror.

12. The method of claim 11, further comprising calibrating a distortion of the hollow laser beam using a calibration part, wherein the calibration part is disposed on a path of the hollow laser beam.

13. The method of claim 10, further comprising reflecting the hollow laser beam to the curved mirror using a second mirror, wherein the second mirror is disposed on a path of the hollow laser beam.

14. The method of claim 10, wherein the first laser beam is a circular laser beam having a pulse wave, wherein the second laser beam is a circular laser beam having a continuous wave, wherein the first laser beam is transformed into the hollow laser beam using a first transformation part disposed on a path of the first laser beam, and wherein the second laser beam is transformed into the hollow laser beam using a second transformation part disposed on a path of the second laser beam.

15. The method of claim 10, wherein the first laser beam is a circular laser beam having a pulse wave and a first wavelength, wherein the second laser beam is a circular laser beam having a continuous wave and a second wavelength.

16. A method for generating light, the method comprising:

generating first and second laser beams;

transforming the first and second laser beams into a hollow laser beam;

reflecting and condensing the hollow laser beam using a curved mirror to generate laser induced plasma in a chamber;

reflecting light emitted from the generated laser induced plasma using the curved mirror; and condensing the light reflected using the curved mirror.

17. The method of claim 16, wherein the first laser beam has a pulse wave and the second laser beam has a continuous wave.

18. The method of claim 16, wherein the first laser beam has a pulse wave and a first wavelength, and the second laser beam has a continuous wave and a second wavelength different from the first wavelength.

19. The method of claim 16, further comprising calibrating a distortion of the hollow laser beam.

20. The method of claim 16, further comprising reflecting the hollow laser beam to the curved mirror using a first mirror, wherein the first mirror is disposed on a path of the generated hollow laser beam.

* * * * *